US006961972B2

(12) United States Patent
Pendell

(10) Patent No.: US 6,961,972 B2
(45) Date of Patent: Nov. 8, 2005

(54) APPARATUS TO AID IN ENTERING AND EXITING A BED

(76) Inventor: Gordon Zachary Pendell, 11618 M-216, Marcellus, MI (US) 49067

( * ) Notice: Subject to any disclaimer, the term of this patent is extended or adjusted under 35 U.S.C. 154(b) by 0 days.

(21) Appl. No.: 10/490,585

(22) PCT Filed: Oct. 9, 2002

(86) PCT No.: PCT/US02/32407

§ 371 (c)(1),
(2), (4) Date: Mar. 23, 2004

(87) PCT Pub. No.: WO03/032885

PCT Pub. Date: Apr. 24, 2003

(65) Prior Publication Data

US 2004/0194216 A1 Oct. 7, 2004

Related U.S. Application Data

(60) Provisional application No. 60/329,883, filed on Oct. 17, 2001.

(51) Int. Cl.[7] ..... A47C 21/08; A61G 7/053

(52) U.S. Cl. ..... 5/662; 5/425

(58) Field of Search ..... 5/662, 623, 658, 5/84.1, 503.1, 600, 602, 621, 424, 425

(56) References Cited

U.S. PATENT DOCUMENTS

| | | | | |
|---|---|---|---|---|
| 4,932,090 | A | 6/1990 | Johansson | |
| 6,240,583 | B1 | 6/2001 | Brooke et al. | |
| 6,397,416 | B2 | 6/2002 | Booke et al. | |
| 6,728,985 | B2 * | 5/2004 | Brooke et al. | 5/662 |
| 2001/0027578 | A1 | 10/2001 | Brooke et al. | |
| 2003/0056293 | A1 * | 3/2003 | Brooke et al. | 5/662 |
| 2004/0194216 | A1 * | 10/2004 | Pendell | 5/662 |
| 2005/0120485 | A1 * | 6/2005 | Sebastien | 5/662 |

* cited by examiner

*Primary Examiner*—Robert G. Santos
(74) *Attorney, Agent, or Firm*—McGarry Bair PC

(57) ABSTRACT

An apparatus is provided to aid a person entering end exiting a bed. The apparatus includes an elongated shaft and a member mounted normally to an end of the elongated shaft. The member is in the same plane as the shaft and is centered relative to the end. The elongated shaft and the member are shaped so as not to have a closed loop. The elongated shaft has a bracket to mount to a bed with the plane parallel to a side of the bed.

16 Claims, 2 Drawing Sheets

APPARATUS TO AID IN ENTERING AND EXITING A BED

CROSS-REFERENCE TO RELATED APPLICATIONS

This application claims priority on International Application No. PCT/US022/32407, filed Oct. 9, 2002, which claims the benefit of U.S. Provisional Application No. 60/329,883, filed Oct. 17, 2001.

BACKGROUND OF THE INVENTION

1. Field of the Invention

The invention relates to beds. More particularly, the invention relates to an apparatus for assisting a person with entering and exiting a bed.

2. Description of the Related Art

Beds of the type utilized in medical care facilities frequently have adjustable side rails. The rails can be lowered to enable the occupant to enter and exit the bed. The rails can be raised to prevent the occupant from falling out of the bed. These rails typically comprise a framework of vertical and horizontal members defining open spaces in a lattice.

Such beds are often subject to stringent governmental safety regulations. They also require the assistance of someone other than the occupant for raising and lowering the rails. For these reasons, beds with adjustable side rails are not ideal for situations such as exist in long term care facilities or assisted living facilities where occupants are more ambulatory and do not need the restraints of bed rails.

Yet there remains a need for some assistance in entering and exiting a bed. For example, elderly persons can benefit from the assistance of a handhold when moving between a standing position adjacent a bed and a prone position on the bed. Moreover, conventional bed rails often interfere with the field of vision of the person in the bed; a person lying on the bed may have to view a television through the latticework of bed rails. Thus there is a need for a device to assist a person in entering and exiting a bed, while at the same time, minimizing interference with the person's field of vision from the bed.

SUMMARY OF THE INVENTION

An apparatus according to the invention meets these needs. In one aspect of the invention, an apparatus to aid a person entering and exiting a bed comprised an elongated shaft, and a member mounted normal to an end of the elongated shaft in the same plane. The member is centered relative to the end, and the apparatus includes some way to mount the elongated shaft to a bed with the plane parallel to a side of the bed. The elongated shaft and the member are disposed to avoid a closed loop. Preferably, the member and the elongated shaft are integral, and the member extends from the end of the elongated shaft via a bight section.

In one embodiment, the member comprises a transverse portion and the bight section is formed of the transverse portion and an inclined portion extending from the end of the elongated shaft. The bight section is large enough so that no body part of a person can get wedged between the transverse portion and the inclined portion.

Preferably, the elongated shaft and the member are free of sharp edges. In one embodiment, the mounting means comprises a mounting bracket. In another, the mounting means comprises bolts and nuts.

In another aspect of the invention, a bed for a person needing health care comprises a head, a side, and an aid for entering and exiting the bed mounted to the side. The aid comprises an elongated shaft extending vertically upward from the side, and a member mounted normal to an upper end of the elongated shaft in the same plane as the plane of the side and centered relative to the end. Preferably, the member and the elongated shaft are integral, and the member extends from the end of the elongated shaft via a bight section. Typically, the bight section will face the head

DESCRIPTION OF THE PREFERRED EMBODIMENT

Figure 1:
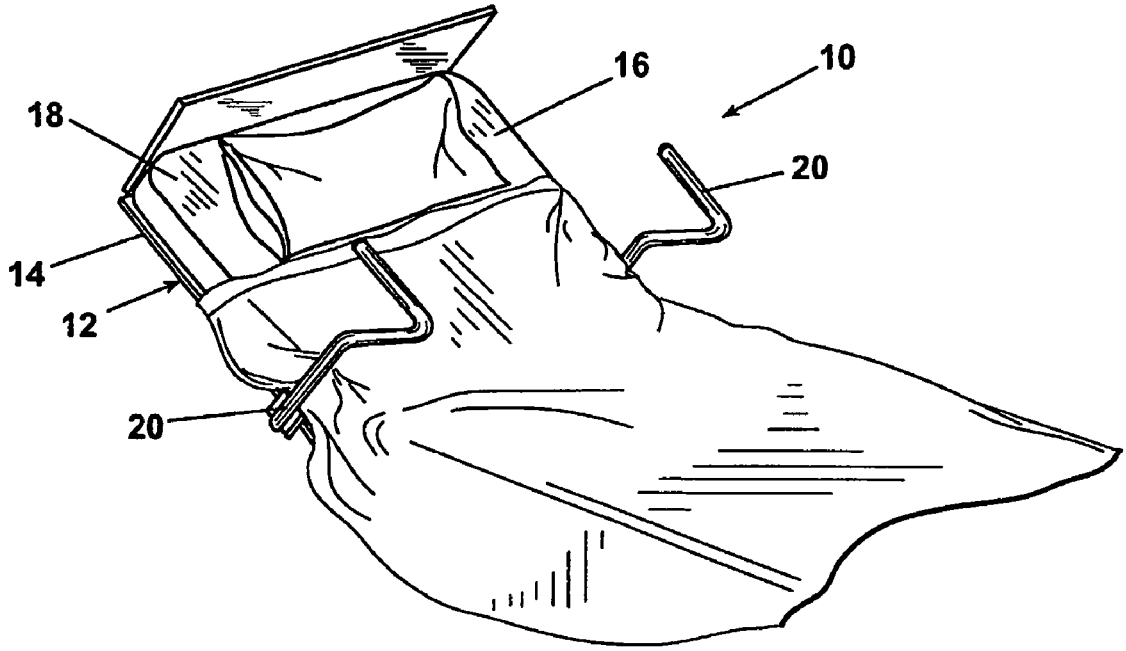
FIG. 1 is a perspective view of a conventional bed provided with an apparatus to aid in entering and exiting the bed according to the invention.

FIG. 1 shows a conventional bed 10 for use in a long term care or assisted living facility. The bed comprises a frame 12 that supports a mattress 18, and has a side rail 14. Normally, there is a side rail 14 on both sides of the frame 12. As shown in FIG. 1, such beds are typically provided with a head portion 16 that can be selectively elevated and lowered. An apparatus 20 according to the invention is preferably attached to the elevated head portion of the bed rail 14 in a position to be adjacent an occupant's upper torso when the occupant is lying on the bed. Preferably, an apparatus 20 according to the invention will be located on both sides of the bed 10, positioned to be adjacent an occupant's upper torso when the occupant is laying on the bed.

Figure 2:
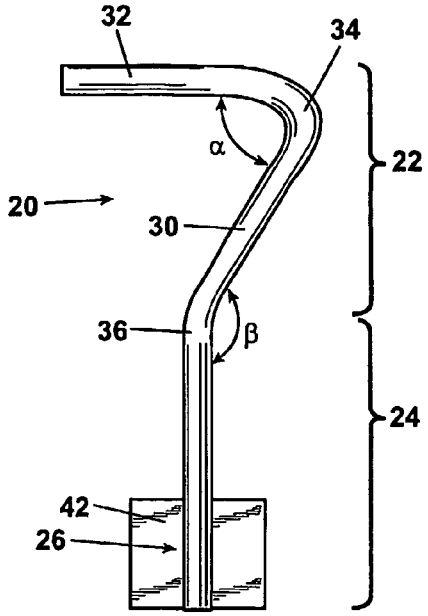
FIG. 2 is a front view of the apparatus of FIG. 1 showing the form of the apparatus.
Figure 3:
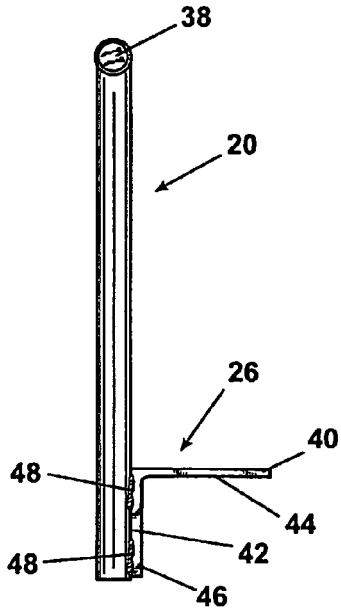
FIG. 3 is a side view of the apparatus of FIG. 1 showing a mounting bracket for mounting the apparatus to the bed.
Figure 4:
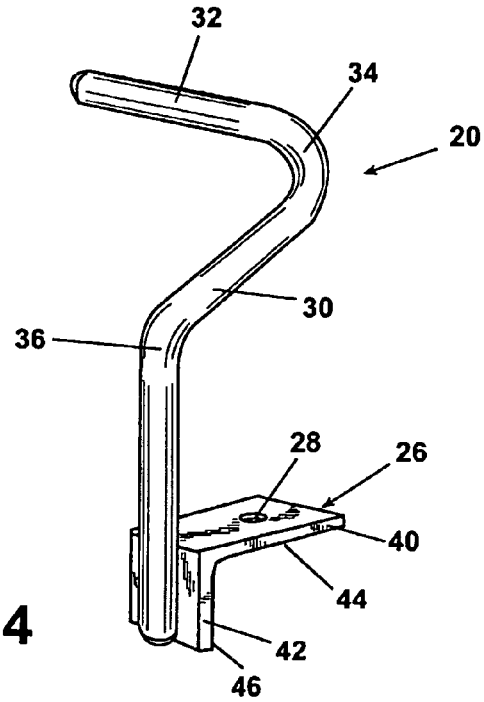
FIG. 4 is a perspective view of the apparatus of FIG. 1 showing further details of the mounting bracket.

Referring now to FIGS. 2–4, the apparatus 20 is fabricated of a rigid material capable of withstanding compressive, torsional, and bending stresses imposed on the apparatus 20 during its use. In the preferred embodiment, the apparatus 20 is fabricated of 1-inch diameter stainless steel tubing with a nominal wall thickness of 0.065 inch, such as a grade 304 stainless steel. Referring specifically to FIG. 2, the tubing is formed into a member 22, functioning as a handle that transitions to an elongated vertical shaft 24 and is centered thereover. It is important the member 22 is mounted to the vertical shaft so as to avoid a closed loop. The handle 22 comprises an inclined section 30 and a transverse section 32. In the preferred embodiment, the transverse section 32 has a length of 9.625 inches, and the inclined section 30 and the transverse section 32 define an angle $\alpha$ of 57°. It is important that the angle a be large enough so that no body part of an occupant can get caught between the transverse section 32 and the inclined section 30 of the handle 22. The inclined section 30 and the transverse section 32 define a bight section 34. The bight section 34 is sized to have a radius that presents a rounded exterior contour so as not to present a sharp edge between the inclined section 30 and the transverse section 32. In the preferred embodiment, the bight section 34 has a radius of 2.25 inches. It may be that the radius of the bight is large enough so as to effectively eliminate an incline section altogether, wherein the curvature of the bight will proceed to transition to the vertical shaft with no linear incline section.

The inclined section 30 transitions to the shaft 24 through a curved section 36. In the preferred embodiment, the curved section 36 and the shaft 24 define an angle β of 147°, and the shaft 24 has a length of 9.125 inches. The overall length of the preferred embodiment is 20.125 inches. The handle 22 and the shaft 24 are oriented so as to generally define a plane. An end cap 38 is located on the free ends of the tubing to provide a finished appearance and cover any rough or sharp edges. Preferably the end cap 38 is a plastic button 38 frictionally retained in each end of the tubing, and each button will have a spherical radius to further minimize sharp edges.

Referring more specifically to FIGS. 3 and 4, an angle bracket 26, comprising an orthogonal leg 40 provided with a mounting aperture 28 therethrough and a parallel leg 42, is attached to the end of the shaft 24. The orthogonal leg 40 comprises a bottom face 44. The parallel leg 42 comprises an inside face 46. The angle bracket 26 comprises a rigid material of suitable strength and durability, such as steel, and is fixedly attached along the parallel leg 42 to the shaft 24, preferably by welds 48, so that the orthogonal leg 40 extends orthogonally to the plane defined by the handle 22 and the shaft 24. Moreover, the orthogonal leg 40 is attached to the shaft 24 so that the shaft 24 extends vertically upward when the orthogonal leg 40 is horizontal.

Referring again to FIG. 1, the apparatus 20 is attached to the bed 10 by attaching the angle bracket 26 to the rail 14 at the elevated head 16 of the bed 10 so that the bottom face 44 is in communication with the top of the rail 14 and the inside face 46 is in communication with the side of the rail 14. The apparatus 20 is oriented so that the bight section 34 is located away from the head of the occupant. In other words, the free end of the transverse section 32 faces towards the head of the occupant. A conventional fastener, such as a machine screw or bolted connector (not shown), passes through the mounting aperture 28 and a mating aperture (not shown) in the rail 14 to rigidly secure the bracket 26 to the rail 14. This also enables the apparatus to be readily removed from the bed 10 when it is not needed. Attachment of the apparatus to the head 16 of the bed 10 enables the apparatus to remain properly oriented with respect to the head 16 when the head 16 is elevated. The apparatus 20 is also preferably attached to the bed 10 so that it is adjacent the occupant's upper torso. This will locate the apparatus 20 where it is most readily available and functional. It will also locate the apparatus 20 where it can most effectively serve as a restraint against the occupant falling from the bed 10. In the event of a fall, the apparatus 20 will tend to restrain the occupant's upper torso, effectively preventing the occupant from exiting the bed "head first."

As shown in FIG. 1, the apparatus 20 can be used in pairs on both sides of the bed 10 to enable the occupant to enter and exit the bed 10 from either side. It will be readily apparent to one of ordinary skill in the art that both devices are identical except that the orientation of the bracket 26 on the shaft 24 will be determined by the side of the bed 10 to which the apparatus 20 is to be mounted.

The occupant can use the apparatus 20 to exit the bed 10 by the grasping one or more of the transverse section 32, the bight section 34, or the inclined section 30 and pulling himself or herself up to a seated position. The occupant can continue grasping the apparatus 20 at an appropriate section to maintain his or her balance while changing from a seated to a standing position. The apparatus 20 can also be used to support the occupant in a standing position next to the bed in situations where the occupant does not wish to leave the bedside. To enter the bed 10, the occupant grasps the apparatus 20 at an appropriate section while taking a seated position on the bed 10. The occupant can then use the apparatus 20 to assist in lowering himself or herself to a reclining position.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention. For example, the manner of attaching the apparatus to the bed has infinite variations. The bracket form illustrated is but one. It is important only that the apparatus be secured to the bed in a manner that will provide stability. For example, the bracket can be clamped, welded, bolted, or wedged into a secure position. It may be that a bracket is altogether unnecessary; for example, the apparatus can be received in a bed socket and secured therein by a setscrew.

I claim:

1. A bed for a person needing health care, the bed comprising a head, a side, and an aid for entering and exiting the bed mounted to the side, wherein the aid comprises an elongated shaft extending vertically upward from the side, and a member mounted normally to an upper end of the elongated shaft in the same plane thereof and having a transverse portion centered relative to a longitudinal axis of the elongated shaft wherein nothing extends from the transverse portion toward the elongated shaft or from the elongated shaft toward the transverse portion which would tend to form a closed loop so that no body part of a person can become inextricably wedged within the member or between the member and the elongated shaft.

2. A bed according to claim 1 wherein the member and the elongated shaft are integral.

3. A bed according to claim 2 wherein the member extends from the end of the elongated shaft via a bight section.

4. A bed according to claim 3 wherein the bight section faces the head.

5. An apparatus to aid a person entering, exiting, or turning in a bed, comprising an elongated shaft, a member extending from an end of the elongated shaft in the same plane thereof and having a transverse portion centered relative to a longitudinal axis of the elongated shaft, and a means for mounting the elongated shaft to a bed with the plane parallel to a side of the bed, wherein nothing extends from the member toward the elongated shaft or from the elongated shaft toward the member which would tend to form a closed loop so that no body part of a person can become inextricably wedged within the member or between the member and the elongated shaft.

6. An apparatus according to claim 5 wherein the member and the elongated shaft are integral.

7. An apparatus according to claim 6 wherein the member extends from the end of the elongated shaft via a bight section.

8. An apparatus according to claim 6 wherein the elongated shaft and the member are free of sharp edges.

9. An apparatus according to claim 7 wherein the bight section is formed of the transverse portion and an inclined portion extending from the end of the elongated shaft.

10. An apparatus according to claim 7 wherein the elongated shaft and the member are free of sharp edges.

11. An apparatus according to claim 9 wherein the radius of the bight section is large enough so that no body part of a person can become inextricably wedged between the transverse portion and the inclined portion.

12. An apparatus according to claim 9 wherein the elongated shaft and the member are free of sharp edges.

13. An apparatus according to claim 11 wherein the elongated shaft and the member are free of sharp edges.

14. An apparatus according to claim 5 wherein the elongated shaft and the member are free of sharp edges.

15. An apparatus according to claim 5 wherein the mounting means comprises a mounting bracket.

16. An apparatus according to claim 5 wherein the mounting means comprises bolts and nuts.

* * * * *